US008973520B2

(12) United States Patent
Chien

(10) Patent No.: US 8,973,520 B2
(45) Date of Patent: Mar. 10, 2015

(54) COATING MACHINE FOR COATING FIBER YARNS

(75) Inventor: Martin Chien, Kaohsiung (TW)

(73) Assignee: Microcrystal Technology Corp., Negara (BN)

( * ) Notice: Subject to any disclaimer, the term of this patent is extended or adjusted under 35 U.S.C. 154(b) by 635 days.

(21) Appl. No.: 13/051,578

(22) Filed: Mar. 18, 2011

(65) Prior Publication Data

US 2012/0234237 A1 Sep. 20, 2012

(51) Int. Cl.

| | |
|---|---|
| ***B05C 1/08*** | (2006.01) |
| ***B05C 1/10*** | (2006.01) |
| ***D06B 3/04*** | (2006.01) |
| ***D06B 1/14*** | (2006.01) |
| ***D06B 15/08*** | (2006.01) |
| ***D06C 7/00*** | (2006.01) |
| ***B05C 11/02*** | (2006.01) |

(52) U.S. Cl.

CPC ..... *D06B 3/045* (2013.01); *B05C 1/0808* (2013.01); *B05C 1/086* (2013.01); *B05C 1/0813* (2013.01); *D06B 1/142* (2013.01); *D06B 1/144* (2013.01); *D06B 15/085* (2013.01); *D06C 7/00* (2013.01); *B05C 1/08* (2013.01); *B05C 11/021* (2013.01)

USPC ..... 118/234; 118/125; 118/423; 118/424; 118/428; 118/429; 118/708; 118/709

(58) Field of Classification Search

CPC ..... B05C 1/08; B05C 1/0813; B05C 1/086; B05C 1/0808; D06B 1/142; D06B 1/144

USPC ..... 118/423, 424, 428, 429, 708, 709

See application file for complete search history.

(56) References Cited

U.S. PATENT DOCUMENTS

| | | | | |
|---|---|---|---|---|
| 2,080,518 | A * | 5/1937 | Underwood | 427/349 |
| 2,280,415 | A * | 4/1942 | Larmuth | 118/125 |
| 2,460,206 | A * | 1/1949 | Wentz | 8/149.1 |
| 4,170,860 | A * | 10/1979 | Flinn et al. | 53/170 |
| 4,704,307 | A * | 11/1987 | Jochem et al. | 427/117 |

FOREIGN PATENT DOCUMENTS

TW I332042 B 10/2010

* cited by examiner

*Primary Examiner* — Dah-Wei D Yuan
*Assistant Examiner* — Stephen Kitt
(74) *Attorney, Agent, or Firm* — Alston & Bird LLP

(57) ABSTRACT

A coating machine for coating fiber yarns includes: a yarn supply device; a coating device including a tank, a drum rotatably disposed in the tank, and at least one annular groove formed circumferentially in an outer surface of the drum; a thickness adjuster disposed downstream of the coating device and including an adjuster support and at least one adjusting die mounted movably to the adjuster support, the adjusting die having a through hole, the through hole having an upstream inlet end and a downstream outlet end and being tapered from the upstream inlet end to the downstream outlet end; a shape-setting device disposed downstream of the thickness adjuster and having a heating unit controllable to operate at a predetermined temperature; a cooling device disposed downstream of the shape-setting device; and a yarn pick-up device disposed downstream of the cooling device.

10 Claims, 9 Drawing Sheets

COATING MACHINE FOR COATING FIBER YARNS

BACKGROUND OF THE INVENTION

1. Field of the Invention

This invention relates to a coating machine for coating fiber yarns.

2. Description of the Related Art

Referring to FIG. 1, a conventional coating machine 1 includes: a yarn supply device 11 for supplying a fiber yarn 100; a tank 12 spaced apart from the yarn supply device 11 and having a plastisol 101 therein; a molding die 13 disposed adjacent to the tank 12; a drying device 14 disposed spacedly from the molding die 13; and a yarn pick-up device 15.

When the fiber yarn 100 passes the tank 12, it is coated with the plastisol 101. When the fiber yarn 100 passes through the molding die 13, the thickness of the plastisol 101 coated on the fiber yarn 100 is adjusted. Thereafter, the coated fiber yarn 100 is set in shape using the heating device 14, and then, is collected using the yarn pick-up device 15.

Taiwanese Patent No. I332042 discloses a method for coating a fiber yarn 100 (a glass fiber yarn) using a pellet extruder 16 (see FIG. 2). Although coating the fiber yarn 100 by using a plastic material extruded from the pellet extruder 16 is more convenient, when the fiber yarn 100 has a relatively small diameter, it is likely to deform. Besides, it is hard to control the fiber yarn 100 to be centrally located in the coated layer, and thus, the coated layer and the fiber yarn 100 are likely to separate from each other. Furthermore, because the fiber yarn 100 is made of a plurality of filaments, the molding die 13 may be plugged by the fiber yarn 100 when the fiber yarn 100 passes therethrough. Thus, the thickness of the coated layer is hard to control, and more seriously, it may be necessary to shut down the coating machine for repair.

Moreover, after the coated fiber yarn 100 leaves the pellet extruder 16, it is guided and pressed by a roller 17 to be cooled in a cooling water tank 13. Because the coated layer on the fiber yarn 100 is not completely cured, the pressure from the roller 17 will deform the coated fiber yarn 102, resulting in an elliptical cross-section, as shown in FIG. 3. This may adversely affect uniformity and surface evenness of a knitted fabric made of the coated fiber yarn 100.

On the other hand, when the fiber yarn 100 passes through the molding die 13 in the conventional coating machine 1 or in the pellet extruder 16, friction between the molding die 13 and the fiber yarn 100 may result in wear of the molding die 13. In order to lengthen the life of the molding die 13, the molding die 13 is usually made of platinum or diamond. Therefore, the coated fiber yarn 100 made by a conventional method or a conventional machine 1 has a relatively high cost.

SUMMARY OF THE INVENTION

Therefore, an object of the present invention is to provide a coating machine for coating fiber yarns that can overcome the aforesaid drawbacks associated with the prior art, and that has improved production efficiency and availability.

Accordingly, a coating machine for coating fiber yarns of this invention comprises:

a yarn supply device to supply at least one fiber yarn;

a coating device including a tank for receiving a coating material, a drum rotatably disposed in the tank, and at least one annular groove formed circumferentially in an outer surface of the drum for receiving the fiber yarn and the coating material and for coating the fiber yarn with the coating material;

a thickness adjuster disposed downstream of the coating device, and including an adjuster support and at least one adjusting die mounted movably to the adjuster support, the adjusting die including a through hole for passage of the coated fiber yarn, the through hole having an upstream inlet end and a downstream outlet end and being tapered from the upstream inlet end to the downstream outlet end;

a shape-setting device disposed downstream of the thickness adjuster for setting the shape of the coated fiber yarn, the shape-setting device having a heating unit controllable to operate at a predetermined temperature for heating the coated fiber yarn;

a cooling device disposed downstream of the shape-setting device for cooling the coated fiber yarn; and a yarn pick-up device disposed downstream of the cooling device for collecting the coated fiber yarn.

BRIEF DESCRIPTION OF THE DRAWINGS

Other features and advantages of the present invention will become apparent in the following detailed description of the preferred embodiments of the invention, with reference to the accompanying drawings, in which.

DETAILED DESCRIPTION OF THE PREFERRED EMBODIMENTS

Figure 1:
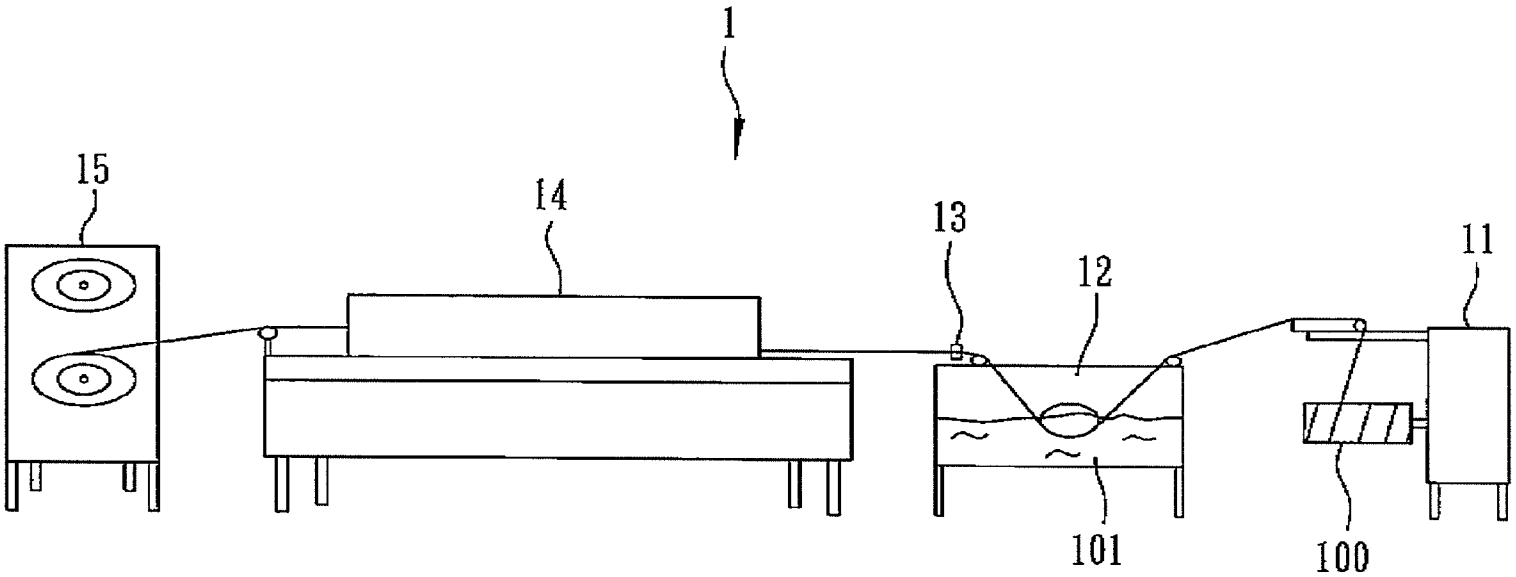
FIG. 1 PRIOR ART
FIG. 1 is a schematic diagram for illustrating a conventional coating machine.

Before the present invention is described in greater detail with reference to the accompanying preferred embodiments, it should be noted herein that like elements are denoted by the same reference numerals throughout the disclosure.

Figure 4:
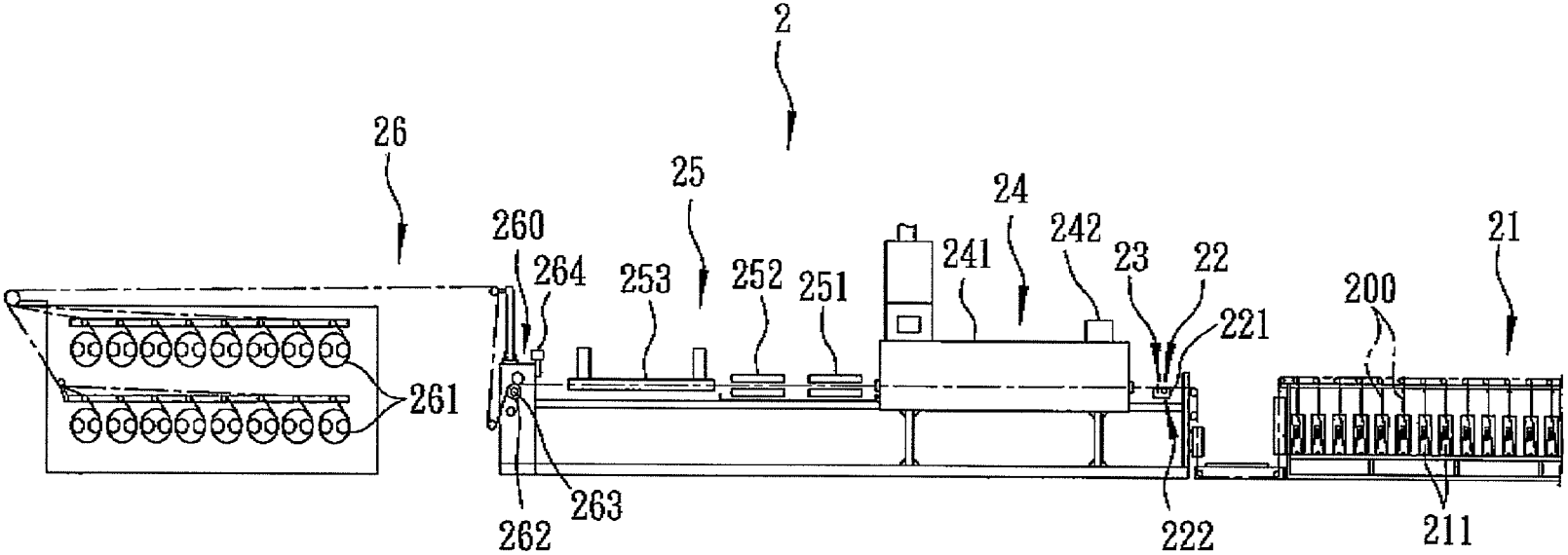
FIG. 4 is a schematic diagram for illustrating the first preferred embodiment of a coating machine according to the present invention.

Referring to FIG. 4, the first preferred embodiment of a coating machine 2 according to the present invention comprises, from upstream to downstream, a yarn supply device 21, a coating device 22, a thickness adjuster 23, a shape-setting device 24, a cooling device 25, and a yarn pick-up device 26.

The yarn supply device 21 supplies a plurality of fiber yarns 200. In the preferred embodiment, the yarn supply device 21 includes forty bobbins 211 to supply forty fiber yarns 200.

Figure 5:
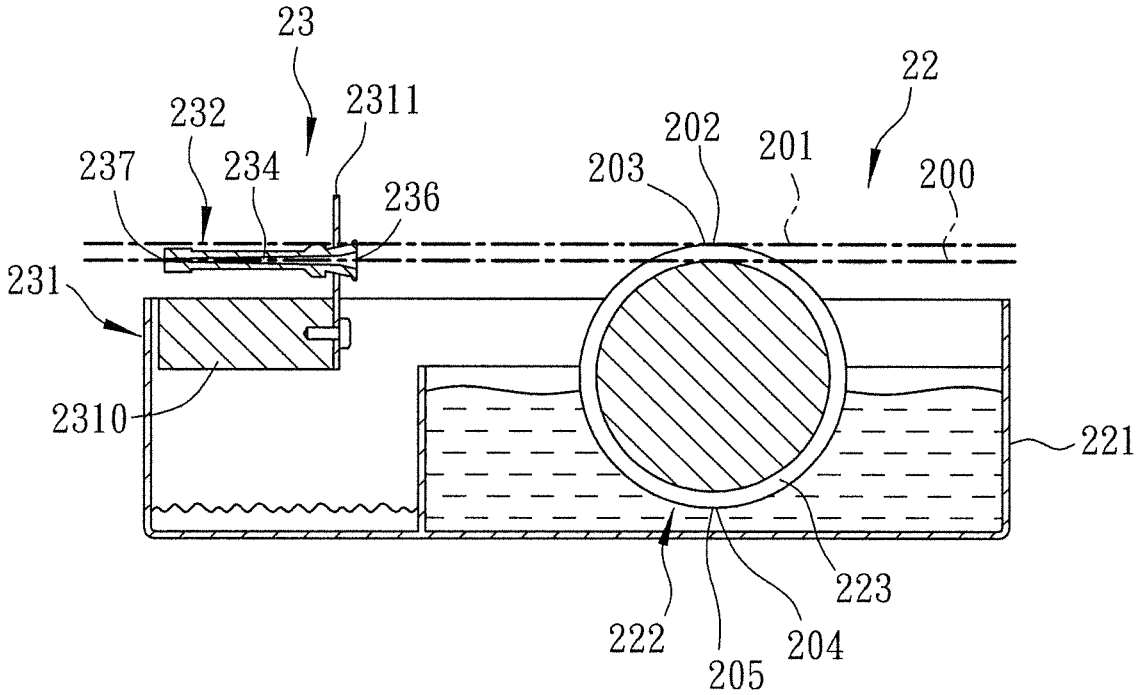
FIG. 5 is a fragmentary enlarged cross-sectional view for illustrating a coating device and a thickness adjuster of the coating machine shown in FIG. 4.
Figure 6:
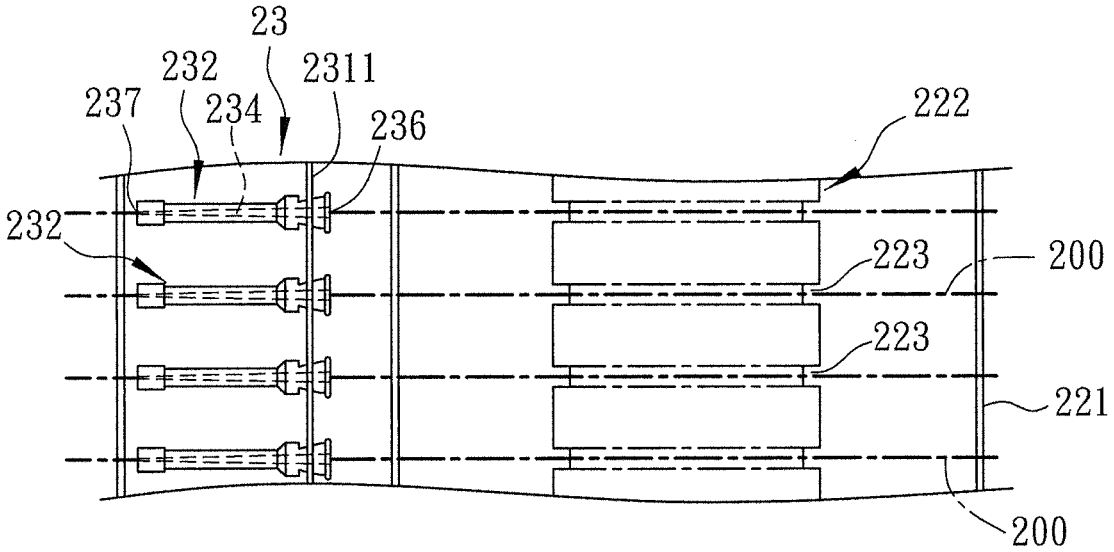
FIG. 6 is a top view of the coating device and thickness adjuster shown in FIG. 5.

Referring to FIGS. 4 to 6, the coating device 22 includes a tank 221 for receiving a coating material, a drum 222 rotatably disposed in the tank 221, and a plurality of annular grooves 223 formed circumferentially in an outer surface of the drum 222 for receiving the fiber yarns 200 and the coating material and for coating the fiber yarns 200 with the coating material. The coating material temporally adheres to the annular grooves 223 with the rotation of the drum 222. The fiber yarns 200 received in the annular grooves 223 can be coated with the coating material and move in a direction away from the yarn supply device 21 through the rotation of the drum 222. In this embodiment, the coating device 22 includes forty annular grooves 223, and the coating material is liquid, and includes polyvinyl chloride (PVC).

Referring to FIGS. 5 and 6, the thickness adjuster 23 is disposed downstream of the coating device 22, and includes an adjuster support 231 and a plurality of adjusting dies 232. Each of the adjusting dies 232 is mounted movably to the adjuster support 231, and has a through hole 234 for passage of a corresponding one of the coated fiber yarns 200. The through hole 234 in each of the adjusting dies 232 has an upstream inlet end 236 and a downstream outlet end 237, and is tapered from the upstream inlet end 236 to the downstream outlet end 237.

Figure 7:
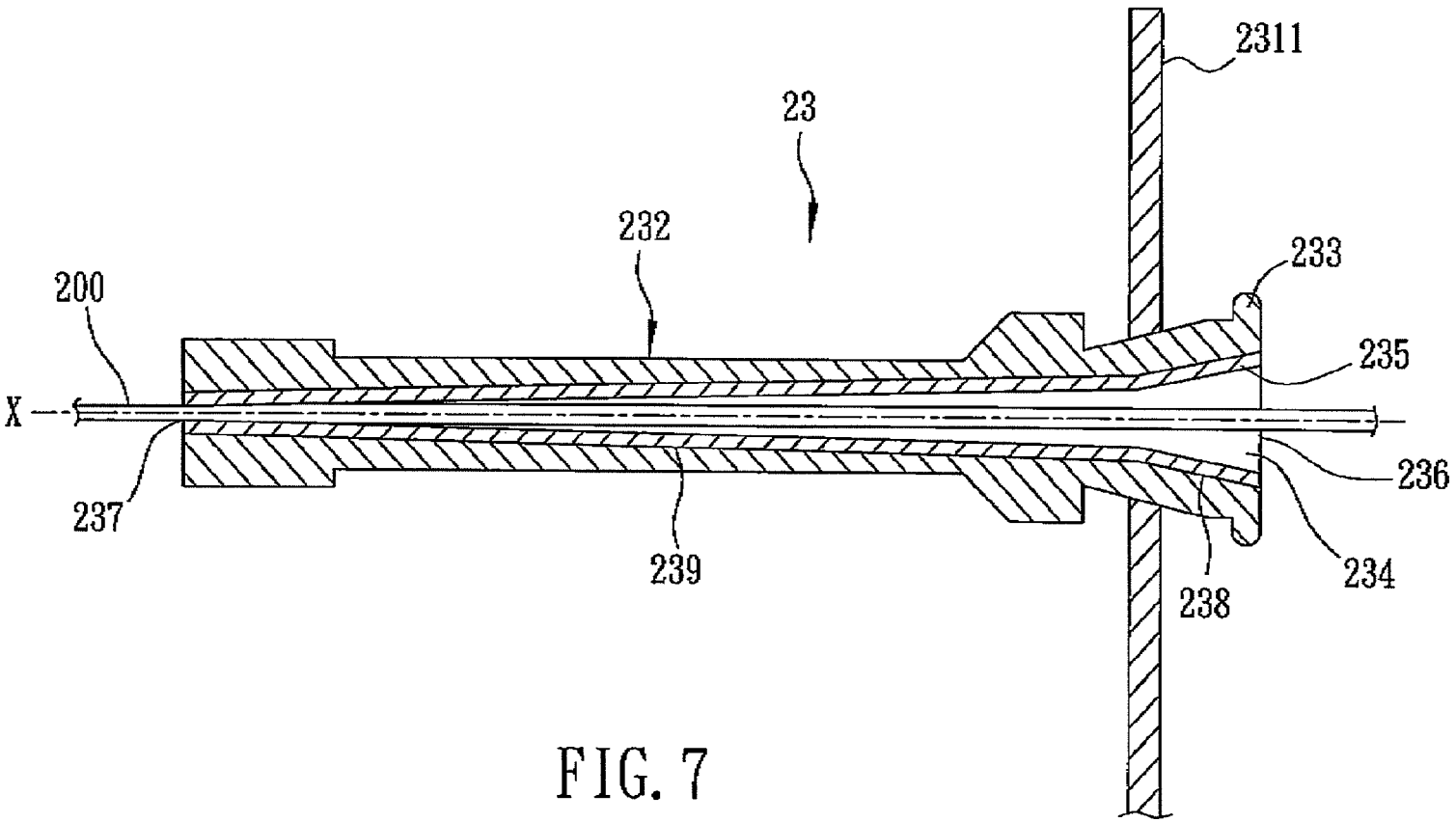
FIG. 7 is a fragmentary enlarged view of the thickness adjuster shown in FIG. 5.

As shown in FIG. 7, each of the adjusting dies 232 further has a surrounding wall 233 defining the through hole 234, and a diamond-like carbon layer 235 that is coated on an inner surface of the surrounding wall 233. A conventional coating method, such as a vapor deposition method may be used to coat the inner surface of the surrounding wall 233. In this embodiment, the thickness adjuster 23 includes forty adjusting dies 232 aligned with the forty annular grooves 223, respectively.

In each of the adjusting dies 232, the surrounding wall 233 includes an upstream section that has the upstream inlet end 236 and that forms a first truncated conical surface 238, and a downstream section that has the downstream outlet end 237 and that forms a second truncated conical surface 239 coaxial with the first truncated conical surface 238. The downstream section is longer than the upstream section. An included angle defined between the first truncated conical surface 238 and an axis (X) of the surrounding wall 233 is greater than that defined between the second truncated conical surface 239 and the axis (X) of the surrounding wall 233.

The shape-setting device 24 is disposed downstream of the thickness adjuster 23 for setting the shape of the coated fiber yarns 200, and includes a heating unit 241 and a monitor 242. The heating unit 241 is controllable to operate at a predetermined temperature for heating the coated fiber yarns 200. The monitor 242 is used to control the heating unit 241.

The shape-setting device 24 also includes a mechanism (not shown) that can be controlled to move the coated fiber yarns 200 within the shape-setting device 24 at a predetermined speed. Preferably, the mechanism moves the coated fiber yarns 200 at a speed of 3 msec. The heating unit 241 can heat the coated fiber yarns 200 to a temperature ranging from 0° C. to 300° C. to cure the coating material coated on the fiber yarns 200. Preferably, the coated fiber yarns 200 are heated to a temperature ranging from 150° C. to 300° C.

Although the coating machine 2 in this embodiment is exemplified for coating forty fiber yarns 200, it can be configured for coating a single fiber yarn 200.

The cooling device 25 is disposed downstream of the shape-setting device 24 for cooling the coated fiber yarns 200, and includes an air cooler 251, a diameter detecting member 252 for detecting a diameter of each of the coated fiber yarns 200, and a cooling gas ejector 253 disposed downstream of the air cooler 251. After passing the cooling device 25, the coated fiber yarns 200 are transported to the yarn pick-up device 26. In this embodiment, the air cooler 251 includes a water-cooled fan, and the cooling gas ejector 253 includes a condenser.

The yarn pick-up device 26 is disposed downstream of the cooling device 25 for collecting the coated fiber yarns 200, and includes a plurality of bobbins 261, a transport roller assembly 260, and a yarn breakage detector 264. The bobbins 261 are spaced apart from each other, and are used for respectively collecting the coated fiber yarns 200 from the cooling device 25. The transport roller assembly 260 is used for transporting the coated fiber yarns 200 from the cooling device 25 to the bobbins 261, and includes a transport roller 262 having an axial flow passage 263 for permitting a coolant to flow therethrough. The yarn breakage detector 264 is disposed between the cooling device 25 and the transport roller assembly 260.

Figure 8:
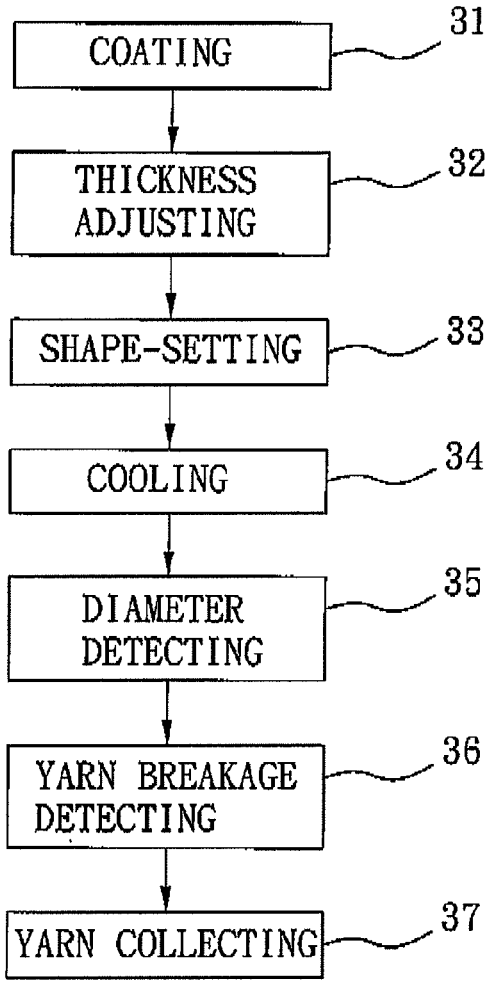
FIG. 8 is a flow chart showing the first preferred embodiment of a method for coating fiber yarns according to the present invention.

Referring to FIG. 8, the first preferred embodiment of a method for coating the fiber yarns 200 according to this invention comprises a coating step 31, a thickness adjusting step 32, a shape-setting step 33, a cooling step 34, a diameter detecting step 35, a yarn breakage detecting step 36, and a yarn collecting step 37.

In some embodiments, the tank (221) of the coating device (22) of the coating machine may be disposed to permit the path of the fiber yarn (200) to extend thereover in a straight line, and the outer circumferential surface of the drum (222) may be rotatable between a topmost position (202), where a tangent line (201) of an uppermost region (203) of the outer circumferential surface may be parallel to the path of the fiber yarn (200), and a bottommost position (204), where a lowermost region (205) of the outer circumferential surface may be immersed in the coating material. In some embodiments, when the outer circumferential surface is rotated to move from the bottommost position (204) to the topmost position (202), the coating material in the tank (221) is drawn up by movement of the lowermost region (205) to the topmost position (202), thereby permitting the fiber yarn to be coated with the coating material. Moreover, in some embodiments, the through hole (234) of the adjusting die (232) of the thickness adjuster (23) may be oriented to be aligned with the path of the fiber yarn (200) that extends over the tank (221) so as to permit passage of the coated fiber yarn therethrough. In some embodiments, when the fiber yarn passes through the coating device (22) and the thickness adjuster (23), it may travel along a straight yarn path. Thus, in some embodiments, the abrasion of the fiber yarn passing through the coating device and the thickness adjuster can be reduced, and the coating material can be uniformly coated over the fiber yarn.

In this embodiment, the method is conducted using the coating machine 2 described above.

Referring back to FIGS. 4 to 6, in the coating step 31, the fiber yarns 200 from the yarn supply unit 21 are oriented and transported by the respective annular grooves 223 on the drum 222. At the same time, the fiber yarns 200 are coated by the coating material adhered to the drum surface in the annular grooves 223. With the rotation of the drum 222, the coating material can be coated on all of the fiber yarns 200.

In the step 32, the coated fiber yarns 200 are guided to enter the respective through holes 234 of the adjusting dies 232 at the upstream inlet ends 236. The excess coating material is removed from the coated fiber yarns 200 when the coated fiber yarns 200 exit the downstream outlet ends 237 of the respective adjusting dies 232, thereby adjusting the thickness of the coating material on the fiber yarns 200.

Referring to FIGS. 5 to 7, the adjuster support 231 includes a support plate 2311 that has a lower end fixed to a base 2310, and a non-supported upper end extending upward from the base 230. Each adjusting die 232 is fixed to the non-supported upper end of the support plate 2311 near the upstream inlet end 236 and is therefore suspended from the support plate 2311. Since the adjusting dies 232 are mounted movably to the adjuster support 231, the adjusting dies 232 are permitted to move relative to the adjuster support 231 when the excess coating material on the fiber yarns 200 is scraped by the adjusting dies 232. Therefore, wear of the adjusting dies 232 can be alleviated, and the life of the adjusting dies 232 can be lengthened without coating the adjusting dies 232 with any expensive material such as platinum. Accordingly, the cost for producing the coated fiber yarns 200 can be reduced. Furthermore, in each of the adjusting dies 232, since the inner surface of the surrounding wall 233 is coated with the diamond-like carbon layer 235, wear-resistance of the adjusting dies 232 is further improved. In addition, since the through hole 234 is tapered from the upstream inlet end 236 to the downstream outlet end 237, the fiber yarn 200 can be centered properly and provided with an even thickness of the coating material.

Figure 2:
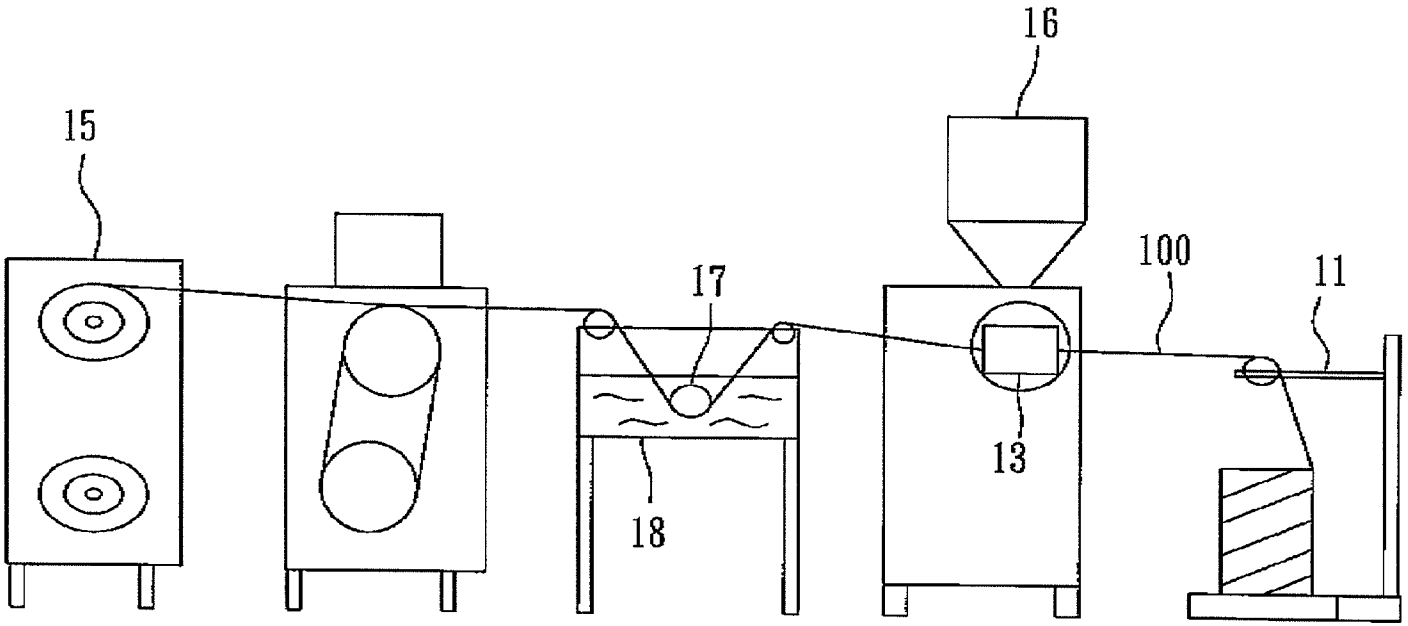
FIG. 2 PRIOR ART
FIG. 2 is a schematic diagram for illustrating how a fiber yarn is coated using a coating method disclosed in Taiwanese Patent No. 1332042.
Figure 3:
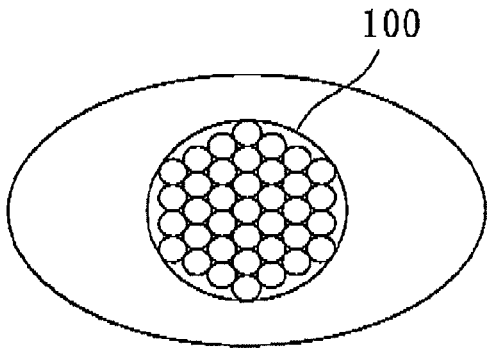
FIG. 3 PRIOR ART
FIG. 3 is a cross-sectional view for illustrating a coated fiber yarn made according to the conventional machine or the conventional method.

In the cooling step 34, the coated fiber yarns 200 are cooled by passing through the air cooler 251 and the cooling gas ejector 253 in sequence. Thereafter, the coated fiber yarns 200 are transported to the yarn pick-up device 26. Since the coating material on the fiber yarns 200 is hardened by the heating unit 241, and then cooled by the air cooler 251 and the cooling gas ejector 253 through a direct contact with cooling air and gas, the present invention eliminates the problem of deformation experienced in the prior art shown in FIG. 2 due to the use of the cooling water tank 18 and the roller 17. Accordingly, the coated fiber yarns 200 can be provided with an even thickness of the coating material.

The diameter detecting step 35 is conducted by detecting the diameter of each of the coated fiber yarns 200 using the diameter detecting member 252, and is conducted simultaneously with the cooling step 34. In the yarn breakage detecting step 36, whether or not each of the coated fiber yarns 200 breaks is detected using the yarn breakage detector 264. The yarn collecting step 37 is conducted by transporting the coated fiber yarns 200 that have been treated by the cooling step 34 to the bobbins 261 through the transport roller assembly 260, followed by collecting the coated fiber yarns 200 using the bobbins 261. By the above steps, the method for coating the fiber yarns 200 can be conducted more smoothly to improve production efficiency and availability.

Figure 9:
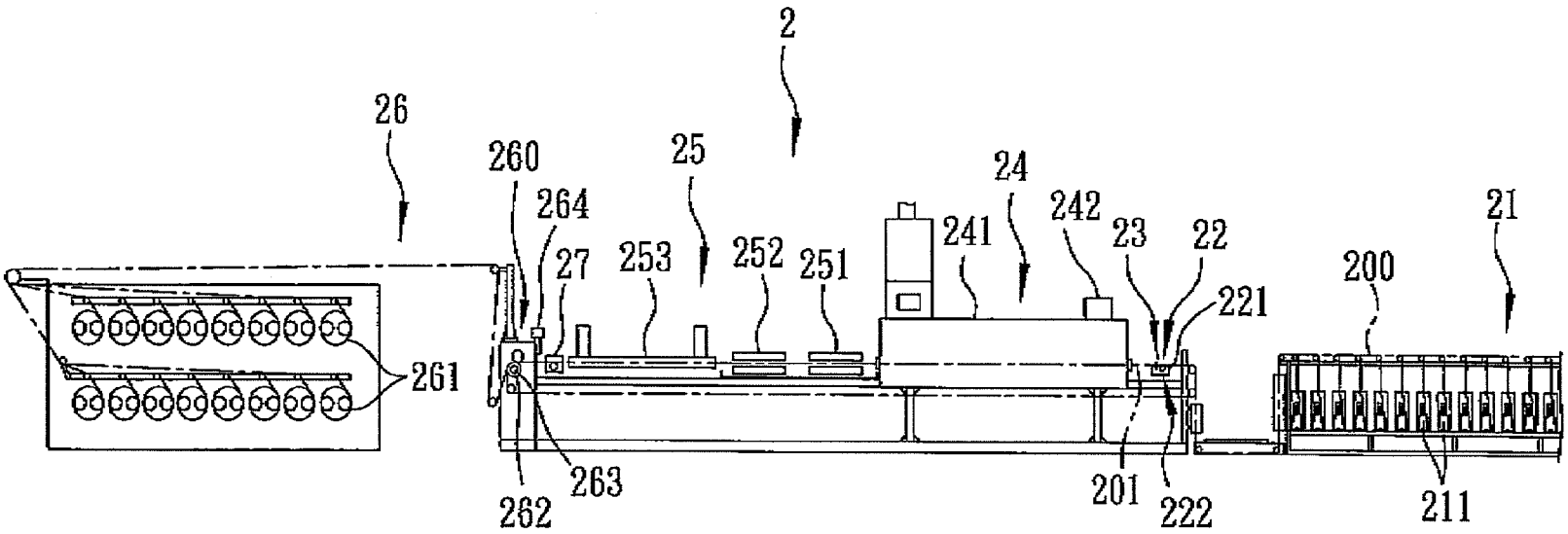
FIG. 9 is a schematic diagram for illustrating the second preferred embodiment of a coating machine according to the present invention.

FIG. 9 illustrates the second embodiment of the coating machine 2 of this invention. The second embodiment differs from the first embodiment in that the coating machine 2 further comprises a returning device 27 disposed downstream of the cooling device 25 and upstream of the yarn pick-up device 26.

In addition, the annular grooves 223 are divided into first and second groups. The first group of the annular grooves 223 is used to conduct a coating operation on the fiber yarns 200 initially fed by the yarn supply device 21. The second group of the annular grooves 223 is used to repeat the coating operation on the fiber yarns 200 that have been coated in the first group of the annular grooves 223. The returning device 27 is operative to return at least one of the fiber yarns 200, which has been coated in one of the annular grooves 223 of the first group and which has been cooled by the cooling device 25, to one of the annular grooves 223 of the second group to repeat the coating operation.

Figure 10:
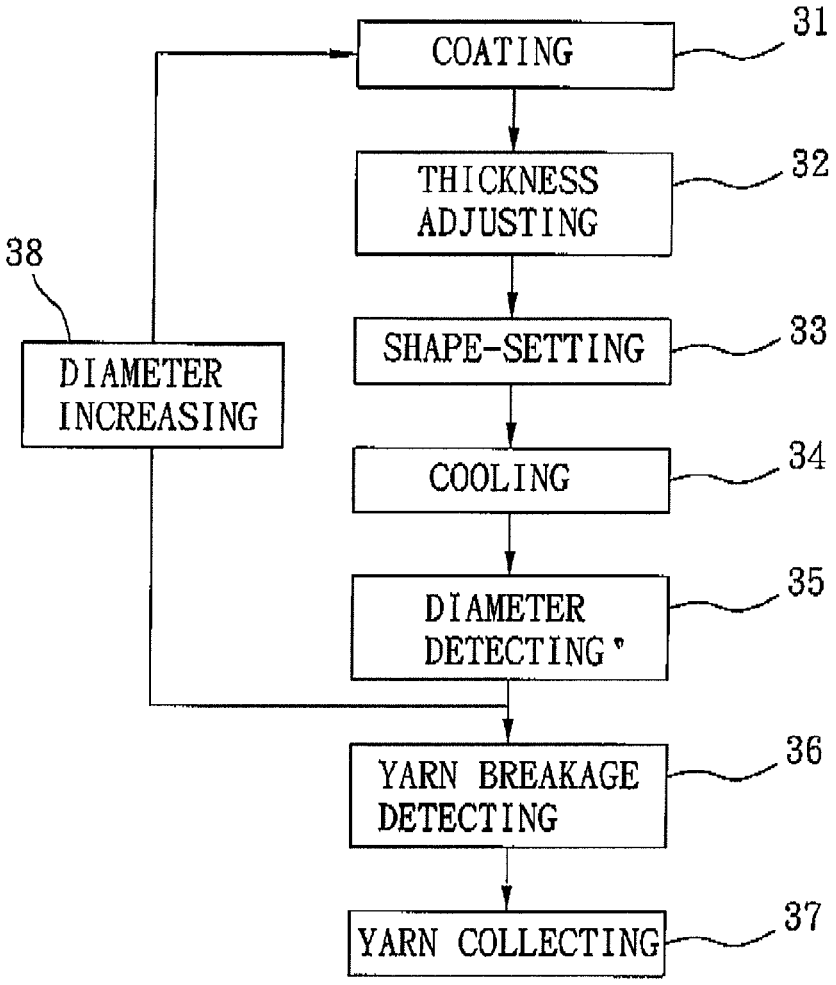
FIG. 10 is a flow chart showing the second preferred embodiment of a method for coating fiber yarns according to the present invention.

FIG. 10 illustrates a flow chart of the second preferred embodiment of a method for coating the fiber yarns 200 according to this invention, which is conducted using the coating machine 2 of the second preferred embodiment. The second embodiment differs from the first embodiment in that the method further comprises a diameter increasing step 38.

In the diameter increasing step 38, the coated fiber yarns 200 that have been treated by the steps 31-35 are returned to the coating device 22 using the returning device 27. Thus, the coated fiber yarns 200 can be coated again with the coating material to have an increased diameter.

In particular, the coating machine 2 is operative for coating forty fiber yarns 200. The coating device 22 includes eighty annular grooves 223 which are divided into the first group of forty annular grooves 223 and the second group of forty annular grooves 223. Furthermore, the thickness adjuster 23 includes eighty adjusting dies 232, each of which is aligned with one of the annular grooves 223.

Therefore, the coating step 31 and the diameter increasing step 38 can be conducted simultaneously by the coating device 22 without interference therebetween.

Besides, since the diameter increasing step 38 is used to repeat coating of the coated fiber yarns 200, the fiber yarns 200 can be provided with a required coating thickness as desired. With the use of the diameter increasing step 3B, it is possible, to prevent the fiber yarns 200 from being overly coated in one time with an excessively thick coating layer, which can lead to difficulties in subsequent hardening and/or cooling of the coating material.

While the present invention has been described in connection with what are considered the most practical and preferred embodiments, it is understood that this invention is not limited to the disclosed embodiments but is intended to cover various arrangements included within the spirit and scope of the broadest interpretations and equivalent arrangements.

What is claimed is:

1. A coating machine for coating fiber yarns, comprising:

a yarn supply device to supply at least one fiber yarn which travels along a yarn path;

a coating device including:

a tank for receiving a coating material and disposed to permit the yarn path to extend thereover in a straight line, a drum rotatably disposed in said tank and having an outer circumferential surface which is rotatable between a topmost position, where a tangent line of an uppermost region of said outer circumferential surface is parallel to the yarn path, and a bottommost position, where a lowermost region of said outer circumferential surface is immersed in the coating material, and at least one annular groove formed circumferentially in said outer circumferential surface of said drum to permit the yarn path to pass through said annular groove in proximity to the topmost position such that when said outer circumferential surface is rotated to move from the bottommost position to the topmost position, the coating material is configured to adhere within the at least one annular groove and be drawn up in the at least one annular groove by movement of said lowermost region to the topmost position, thereby permitting the fiber yarn to be coated on all sides with the coating material;

a thickness adjuster disposed downstream of said coating device, and including an adjuster support and at least one adjusting die mounted movably to said adjuster support, said adjusting die including a through hole which is oriented to be aligned with the yarn path that extends over said tank so as to permit passage of the coated fiber yarn therethrough, said through hole having an upstream inlet end and a downstream outlet end and being tapered from said upstream inlet end to said downstream outlet end;

a shape-setting device disposed downstream of said thickness adjuster for setting the shape of the coated fiber yarn, said shape-setting device including a heating unit controllable to operate at a predetermined temperature for heating the coated fiber yarn;

a cooling device disposed downstream of said shape-setting device for cooling the coated fiber yarn; and a yarn pick-up device disposed downstream of said cooling device for collecting the coated fiber yarn.

2. The coating machine of claim 1, wherein said adjusting die further includes a surrounding wall defining said through hole, and a diamond-layer coated on an inner surface of said surrounding wall.

3. The coating machine of claim 1, wherein said cooling device includes an air cooler, a diameter detecting member for detecting a diameter of the coated fiber yarn, and a cooling gas ejector disposed downstream of said air cooler.

4. The coating machine of claim 1, wherein said yarn pick-up device includes at least one bobbin for collecting the coated fiber yarn, a transport roller assembly for transporting the coated fiber yarn from said cooling device to said bobbin, and a yarn breakage detector disposed between said cooling device and said transport roller assembly, said transport roller assembly including a transport roller that has an axial flow passage for permitting a coolant to flow therethrough.

5. The coating machine of claim 1, wherein said shape-setting device further includes a monitor to control said heating unit.

6. The coating machine of claim 2, wherein said surrounding wall of said adjusting die includes an upstream section that has said upstream inlet end and that forms a first truncated conical surface, and a downstream section that has said downstream outlet end and that forms a second truncated conical surface coaxial with said first truncated conical surface, an included angle defined between said first truncated conical surface and an axis of said surrounding wall being greater than that defined between said second truncated conical surface and said axis.

7. The coating machine of claim 6, wherein said downstream section is longer than said upstream section.

8. The coating machine of claim 1, wherein said adjusting die is fixed to said adjuster support near said upstream inlet end and is suspended from said adjuster support.

9. The coating machine of claim 1, wherein said yarn supply device is able to supply a plurality of the fiber yarns, said coating device including a plurality of said annular grooves for coating the fiber yarns with the coating material, said thickness adjuster including a plurality of said adjusting dies each including said through hole for passage of a corresponding one of the fiber yarns that has been coated.

10. The coating machine of claim 9, further comprising a returning device disposed downstream of said cooling device and upstream of said yarn pick-up device, said annular grooves being divided into first and second groups, said first group of said annular grooves being used to conduct a coating operation on the fiber yarns initially fed by said yarn supply device, said second group of said annular grooves being used to repeat the coating operation on the fiber yarns that have been coated in said first group of said annular grooves, said returning device being operative to return at least one of the fiber yarns, which has been coated in one of said annular grooves of said first group and which has been cooled by said cooling device, to one of said annular grooves of said second group to repeat the coating operation.

* * * * *